United States Patent [19]

Steinhilber

[11] Patent Number: 4,669,252

[45] Date of Patent: Jun. 2, 1987

[54] MANUAL COIN COUNTER AND PACKAGER

[76] Inventor: Wallace F. Steinhilber, 1418 Marcelina, Torrance, Calif. 90501

[21] Appl. No.: 889,828

[22] Filed: Jul. 24, 1986

[51] Int. Cl.[4] ..... B65B 39/02

[52] U.S. Cl. ..... 53/390; 53/254; 53/532

[58] Field of Search ..... 53/390, 254, 213, 212, 53/532; 133/1 A, 1 R

[56] References Cited

U.S. PATENT DOCUMENTS

| | | | |
|---|---|---|---|
| 1,443,481 | 1/1923 | Lavigne et al. | 53/254 |
| 2,444,804 | 7/1948 | Carruthers | 53/254 |
| 2,794,305 | 6/1957 | Economos | 53/254 X |
| 2,802,325 | 8/1957 | Capodanno | 53/254 |
| 2,977,736 | 4/1961 | Condis | 53/254 |
| 4,091,599 | 5/1978 | Lemieux | 53/254 |
| 4,244,157 | 1/1981 | Vondra et al. | 53/254 |

FOREIGN PATENT DOCUMENTS

| | | | |
|---|---|---|---|
| 553110 | 1/1933 | Fed. Rep. of Germany | 53/254 |

*Primary Examiner*—James F. Coan

*Attorney, Agent, or Firm*—Poms, Smith, Lande & Rose

[57] ABSTRACT

A manual coin counting and packaging apparatus for quickly measuring the predetermined number of coins necessary to fill a paper coin roll wrapper of any denomination and for inserting the coins into the coin roll wrapper. The apparatus includes a transparent counting sleeve with indicia marking the proper height for a stack of, for example, pennies, nickels, and dimes. A packaging sleeve is also provided which includes a fixed diameter opening which can attach to the counting sleeve, and a variable diameter opening which can be easily inserted into a paper coin wrapper of any denomination. With the packaging sleeve completely inserted into the coin wrapper, the force of gravity may be employed to shift the coins out of the sleeve and into the paper wrapper as the sleeve is lifted out of the wrapper.

17 Claims, 6 Drawing Figures

MANUAL COIN COUNTER AND PACKAGER

FIELD OF THE INVENTION

This invention pertains to an apparatus for quickly measuring the predetermined number of coins necessary to fill a coin roll wrapper of any denomination, and for inserting the coins into the coin wrapper.

BACKGROUND OF THE INVENTION

Coins are commonly stored in rolls of a specific number of coins encased in paper or plastic wrappers. For example, a roll of pennies contains 50 pennies, a roll of nickels contains 40 nickels, a roll of dimes contains 50 dimes, and a roll of quarters contains 40 quarters.

Insuring that the correct number of coins is inserted into the wrapper can be very time-consuming if the coins are individually counted. In addition, inserting the coins into the wrappers by hand is also time-consuming as the wrappers do not readily accept the coins.

Numerous coin packaging devices have been proposed heretofore to reduce the time for counting coins and inserting them into coin wrappers. For example, U.S. Pat. No. 2,444,804 to Carruthers discloses a coin counting and packaging device. However, it is usable with only one denomination of coins, and it does not solve the above-mentioned difficulty of the coin wrapper not readily accepting coins. U.S. Pat. No. 2,802,325 by Capodanno discloses another counting and packaging device. It also can be used with only one coin denomination, and only gives a partial solution to the above-mentioned problem of the wrapper not easily accepting coins. U.S. Pat. Nos. 2,977,736 and 4,091,599 by Condis and Lemieux, respectively, each disclose coin counting and packaging devices which can be used with only one coin denomination.

Accordingly, it is a principal object of this invention to provide a manual coin counting and packaging apparatus which allows rapid counting of a predetermined number of more than one denomination of coins, such as pennies, nickels, and dimes.

It is a further object to provide a coin counting and packaging apparatus which enables a stack of any of several denominations of coins to be rapidly loaded into a corresponding coin roll wrapper.

SUMMARY OF THE INVENTION

The present invention involves a manual coin counting and packaging assembly for use with predetermined stacks of coins.

More particularly, the counting and packaging apparatus includes a coin counting sleeve and a packaging sleeve. The coin counting sleeve has a height equal to or slightly greater than the height of the predetermined stack, and includes an accurate marking or indication of the height of the predetermined stack. The counting sleeve is preferably made of transparent plastic.

The packaging sleeve includes a fixed diameter end, and a flexible, variable diameter end for extending into a paper coin wrapper. The packing sleeve has a length greater than the height of the predetermined stack of coins. A collar connects the fixed diameter end of the packing sleeve to the counting sleeve.

The assembly can be used with more than one denomination of coins. In this case, the counting sleeve includes a marking indicating the height of each denomination of predetermined stack. For example, the counting sleeve might include markings for a penny level, a nickel level and a dime level.

To use the coin counting and packaging apparatus, the user places pennies, nickels, or dimes into the counting sleeve until the stack height reaches the respective penny, nickel, or dime marker which indicates the proper number of coins used to fill a coin roll wrapper. The fixed diameter end of the packaging sleeve is then attached to the counting sleeve and the flexible, variable end of the packaging sleeve is inserted completely into the coin wrapper. Upon placing the counting sleeve at a higher elevation than the coin wrapper, and twisting and lightly shaking the packaging sleeve, gravity will pull the coins into the coin wrapper as the packaging sleeve is pulled out of the wrapper.

Other objects, features, and advantages, of the present invention will become apparent from a consideration of the following detailed description and from the accompanying drawings.

DETAILED DESCRIPTION

Figure 1:
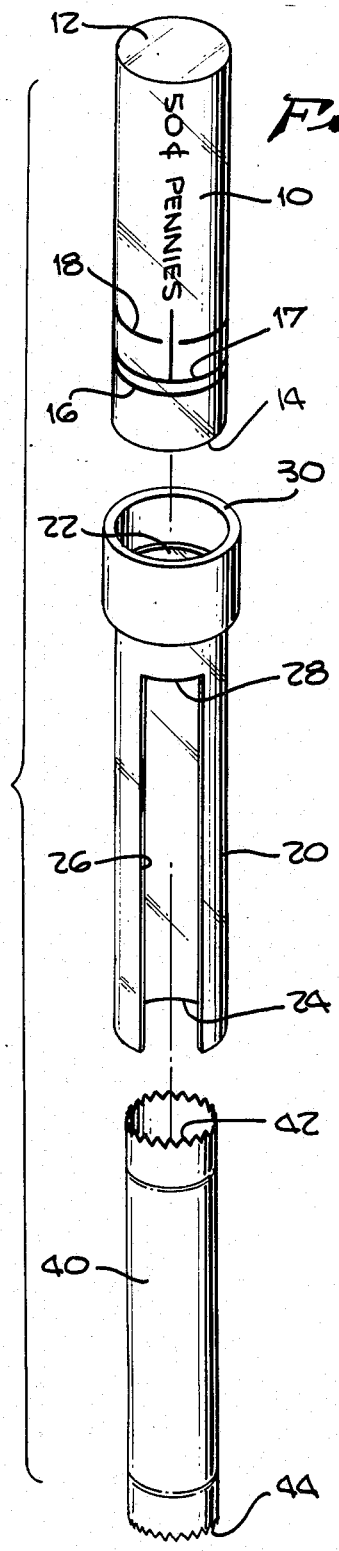
FIG. 1 is an exploded perspective view of the counting sleeve, packaging sleeve, and a paper coin roll wrapper.

FIG. 1 is an exploded perspective view of a counting sleeve 10, packaging sleeve 20, and coin wrapper 40.

Figure 2A:
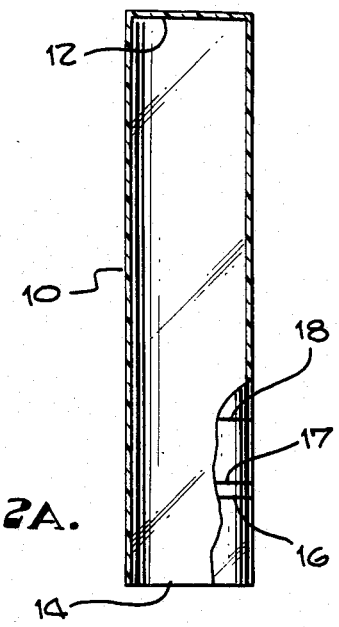
FIG. 2A is a cross-sectional view taken axially through the manual coin-counting sleeve.

The manual counting sleeve 10 shown in the upside-down or unloading orientation in FIG. 2A and at the top in FIG. 1, has a closed end 12 and an open end 14. Counting sleeve 10 is preferably made of transparent plastic.

Figure 2B:
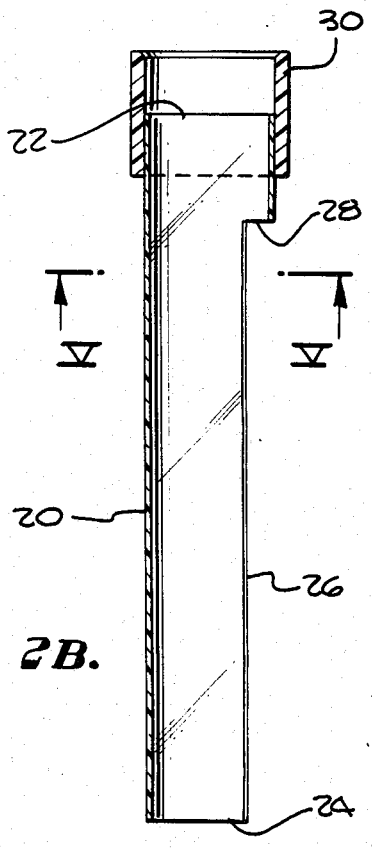
FIG. 2B is a cross-sectional view taken axially through the packaging sleeve.

FIG. 2B and the central portion of FIG. 1 show a manual coin packaging sleeve 20 which includes a fixed diameter opening 22 and a variable diameter opening 24. A cylindric collar 30 is attached to packaging sleeve 20 around fixed diameter opening 22.

Collar 30 has a diameter such that it fits snugly over the open end 14 of the counting sleeve 10. It can thus be used to easily connect and disconnect counting sleeve 10 to packaging sleeve 20.

Packaging sleeve 20 includes a cutout portion 26 extending from end 28 near the fixed diameter opening 22 to the variable diameter opening 24. Cutout portion 26 has a width which is substantially less than the diameter of packaging sleeve 20. Cutout portion 26 enables the diameter of the variable diameter opening 24 to be easily varied.

Figure 3:
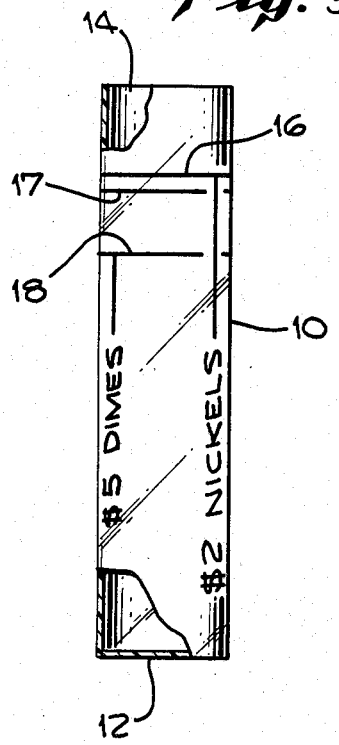
FIG. 3 is an elevation view of the coin counting sleeve.

FIGS. 1 and 3 show counting sleeve 10 with nickel level marking 16, penny level marking 17, and dime level marking 18. A stack of coins extending from closed end 12 to markings 16, 17 or 18 indicate 40 nickels, 50 pennies, or 50 dimes respectively. Counting sleeve 10 includes the legend "$5 Dimes" connected to the dime level marking 18, and the label "$2 Nickels" connected to the nickel level marking 16. "50 cents pennies" is shown on FIG. 1, connected to the penny level marking 17.

Figure 4:
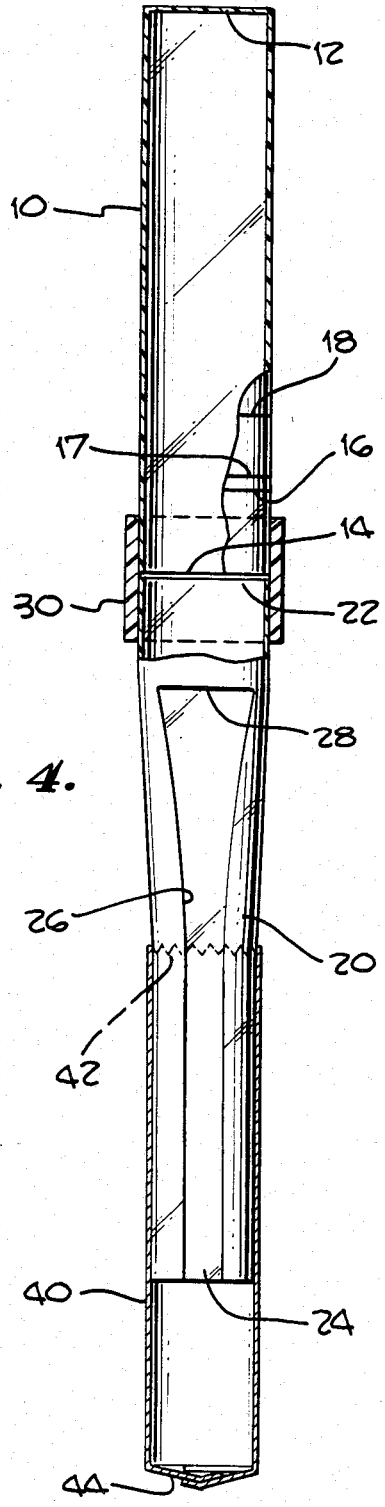
FIG. 4 is a partial cross-sectional view taken axially of the combined counting sleeve, packaging sleeve and coin roll wrapper.
Figure 5:
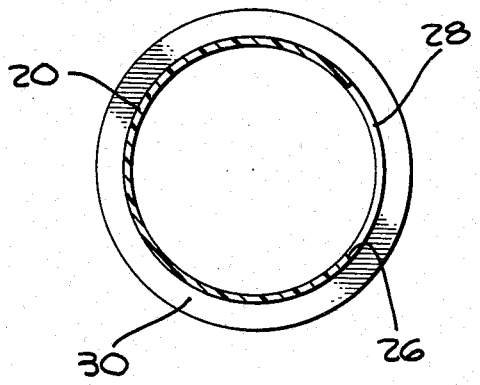
FIG. 5 is a cross-sectional view taken along lines V—V of FIG. 2B.

FIG. 4 shows the assembled counting sleeve 10, packaging sleeve 20, and paper coin wrapper 40. FIG. 5 shows a cross-sectional view taken along lines V—V of FIG. 2B.

In operating the apparatus, a user fills the counting sleeve 10 with nickels, pennies, or dimes to the appropriate level 16, 17 or 18. Packaging sleeve 20 is then connected to counting sleeve 10 with collar 30. Next, the flexible end of packaging sleeve 20 having the variable diameter opening 24, is inserted into open end 42 of paper coin wrapper 40, and the packaging sleeve 20 is pushed into the paper coin wrapper 40 until variable diameter end 24 is near paper coin wrapper closed end 44. Incidentally, when a new paper wrapper is used the closed end 44 may be folded closed when the end of sleeve 20 is located about one-half inch back from the end of the paper wrapper. The combined counting sleeve, packaging sleeve, and coin wrapper are then turned upside-down so that counting sleeve 10 is above coin wrapper 40. By lightly shaking and twisting packaging sleeve 20, the coins will rapidly be pulled by gravity into coin wrapper 40 as packaging sleeve 20 is pulled out of coin wrapper 40.

A working model has been constructed with the counting sleeve having a diameter of $\frac{7}{8}$ inch and a length of 3-14/16 inches, the packaging sleeve having a diameter at the fixed diameter end of 15/16 inch and a length of 5 inches, and the collar having an outer diameter of 1 inch and a length of $\frac{3}{4}$ inch. A stack of 40 nickels is 3 inches tall and 13/16 inch in diameter. A stack of 50 pennies is 2-15/16 inches tall and $\frac{3}{4}$ inch in diameter. A stack of dimes is $2\frac{1}{2}$ inches tall and 11/16 inch in diameter.

Another working model has been constructed which is capable of being used with quarters. The counting sleeve and packaging sleeves have lengths and diameters of 2-13/16 inches, 1 inch, and 4-13/16 inches, 1-1/16 inches, respectively.

Preferably, packaging sleeve 20 is made of a transparent flexible plastic, and collar 30 is made of white stiff plastic.

In conclusion, it is to be understood that the foregoing detailed description and the accompanying drawings relate to a preferred embodiment of the invention, and that various changes in the form and details thereof may be made without departing from the scope of the invention. Thus, by way of example and not of limitation, a single embodiment may be employed for handling both quarters and nickels, or for handling pennies, nickels, dimes and quarters; the closed end of slot 26 may be rounded, or the slot 26 may be tapered, and the counting sleeve could be opaque with small openings or holes to determine coin stack height. Further, the top of the counting sleeve could constitute a marking indicating the proper height for a stack of coins. Accordingly, the present invention is not limited to the embodiments specifically described hereinabove, or shown in the drawings.

What is claimed is:

1. A manual coin counting and packaging apparatus for use with predetermined stacks of coins of a plurality of different coin denominations and coin wrappers from a corresponding set of coin roll wrappers, comprising:

a counting sleeve with height markings corresponding to the heights of said predetermined stacks of different coin denominations;

a packaging sleeve physically separate from said counting sleeve, said packaging sleeve including a fixed diameter opening and a variable diameter opening, said packaging sleeve having a length greater than the length of the highest predetermined stack, and said variable diameter opening including longitudinally extending means for insertion into one end of each wrapper in the set of coin roll wrappers and extending through the greater portion of the length of each wrapper in the set of coin roll wrappers; and means for connecting said counting sleeve to said packaging sleeve.

2. The apparatus of claim 1 wherein the distances from the bottom of said counting sleeve to said height markings are equal to the height of a stack of the standard number of coins in standardized coin wrappers for corresponding denominations.

3. The apparatus of claim 1 in which the packaging sleeve is flexible and includes a cutout portion which allows the diameter of the flexible variable diameter end to vary.

4. The apparatus of claim 1 in which each wrapper in the set of coin roll wrappers is a conventional paper coin roll wrapper.

5. The apparatus of claim 1 in which the plurality of different coin denominations consists of pennies, nickels, and dimes, and the corresponding set of coin roll wrappers consists of penny, nickel and dime coin roll wrappers respectively.

6. The apparatus of claim 1 in which the plurality of different coin denominations consists of pennies, nickels, dimes and quarters, and the corresponding set of coin roll wrappers consists of penny, nickel, dime and quarter coin roll wrappers respectively.

7. The apparatus of claim 1 in which the counting sleeve is a cylinder with a closed end and an open end, and the heights of the stacks are measured from the closed end to the markings corresponding to predetermined heights.

8. The apparatus of claim 1 in which the means for connecting said counting sleeve to said packaging sleeve is a collar which surrounds an open end of the counting sleeve and the fixed diameter opening of the packaging sleeve.

9. A manual coin counting and packaging apparatus for use with pennies, nickels, and dimes, and penny, nickel, and dime flexible coin roll wrappers comprising:

a counting sleeve including a closed end, and a penny marking, a nickel marking, and a dime marking, wherein a stack of pennies from the closed end to the penny marking has 50 pennies, a stack of nickels from the closed end to the nickel marking has 40 nickels, and a stack of dimes from the closed end to the dime marking has 50 dimes;

a packaging sleeve including a fixed diameter opening and a variable diameter opening, said packaging sleeve having a length greater than the length of a stack of 50 nickels, and said variable diameter opening including means for insertion through substantially the entire length of said penny, nickel, and dime coin roll wrappers while said packaging sleeve contains 50 pennies, 40 nickels, and 50 dimes respectively, and for withdrawal from the penny, nickel and dime wrappers, respectively after each of the 50 pennies, 40 nickels, and 50 dimes respectively has passed from the packaging sleeve through the variable diameter opening into the penny, nickel, and dime wrappers respectively; and means for connecting said counting sleeve to said packaging sleeve.

10. An assembly as defined in claim 9 wherein said packaging sleeve is physically separate from said counting sleeve, and said connecting means couples the normally separate sleeves together.

11. An assembly for manually counting and packaging a predetermined stack of coins comprising:

a coin counting tube, said tube having a height equal to or slightly greater than the height of said predetermined stack of coins, and including means for accurately indicating the height of said predetermined stack;

a packaging sleeve including a fixed diameter end, and a flexible variable diameter end for extending into a flexible coin package, said variable diameter end having a length greater than the height of said predetermined stack of coins; and coupling means for selectively mechanically interconnecting said counting sleeve to said packaging sleeve to feed counted coins into the flexible coin package.

12. The assembly of claim 11 further including means for accurately indicating the height of at least one other predetermined stack of coins, and wherein said variable diameter end has a length greater than the height of the highest height of the predetermined stacks.

13. The assembly of claim 12 in which there are predetermined stacks of pennies, nickels, and dimes.

14. The apparatus of claim 11 in which the counting tube is a cylinder with a closed end and an open end, and the height of the stack is measured from the closed end to marking means corresponding to a predetermined height.

15. The apparatus of claim 11 in which the means for mechanically interconnecting said counting tube to said packaging sleeve is a collar which surrounds an open end of the counting tube and the fixed diameter opening of the packaging sleeve.

16. The apparatus of claim 11 in which the packaging sleeve is flexible and includes a cutout portion which allows the diameter of the flexible variable diameter end to vary.

17. A manual coin counting and packaging apparatus for use with predetermined stacks of coins of a plurality of different coin denominations and coin wrappers from a corresponding set of coin roll wrappers, comprising:

a counting sleeve with height markings corresponding to the heights of said predetermined stacks of different coin denominations, the distances from the bottom of said counting sleeve to said height markings being equal to the height of a stack of the standard number of coins in standardized coin wrappers for corresponding denominations;

a packaging sleeve including a fixed diameter opening and a variable diameter opening, said packaging sleeve having a length greater than the length of the highest predetermined stack, and said variable diameter opening including longitudinally extending means for insertion into one end of each wrapper in the set of coin roll wrappers and extending through the greater portion of the length of each wrapper in the set of coin roll wrappers;

the variable diameter end of said packaging sleeve including means for insertion through substantially the entire length of each wrapper, with said packaging sleeve having a sufficient length to contain the standard number of coins corresponding to each wrapper, and for withdrawal from each wrapper after each of the coins has passed through the packaging sleeve and through the variable diameter opening into each wrapper; and means for connecting said counting sleeve to said packaging sleeve.

* * * * *